US006189999B1

(12) United States Patent
Pham et al.

(10) Patent No.: US 6,189,999 B1
(45) Date of Patent: Feb. 20, 2001

(54) MULTI-FACETED WIPER SCRAPER SYSTEM FOR INKJET PRINTHEADS

(75) Inventors: Le Pham; Todd R. Medin, both of Vancouver, WA (US); Michael Payne, Clackamas, OR (US)

(73) Assignee: Hewlett-Packard Company, Palo Alto, CA (US)

( * ) Notice: Under 35 U.S.C. 154(b), the term of this patent shall be extended for 0 days.

(21) Appl. No.: 09/302,909

(22) Filed: Apr. 30, 1999

(51) Int. Cl.[7] ..... B41J 2/165
(52) U.S. Cl. ..... 347/33
(58) Field of Search ..... 347/33, 28

(56) References Cited

U.S. PATENT DOCUMENTS

| | | | | |
|---|---|---|---|---|
| 3,977,868 | * | 8/1976 | Hwa | 134/6 |
| 4,162,652 | * | 7/1979 | Rebel et al. | 101/425 |
| 5,614,930 | | 3/1997 | Osborne et al. | 347/33 |
| 5,815,176 | | 9/1998 | Rotering | 347/33 |
| 5,914,734 | * | 11/1999 | Rotering et al. | 347/28 |
| 5,949,448 | | 9/1999 | Man et al. | 347/33 |
| 5,980,018 | | 11/1999 | Taylor et al. | 347/31 |
| 5,984,452 | * | 11/1999 | Bekki | 347/33 |

FOREIGN PATENT DOCUMENTS

| | | | |
|---|---|---|---|
| 3042998 | * | 7/1982 | (DE) . |
| 0 437 361 | | 7/1991 | (EP) . |
| 404278358 | | 10/1992 | (JP) . |
| 5185599 | | 7/1993 | (JP) . |
| 406143597 | | 5/1994 | (JP) . |

OTHER PUBLICATIONS

Commonly assigned, co–pending, U.S. patent application Ser. No. 08/667,611, filed Jul. 3, 1996, entitled "Integrated Translational Service Station for Inkjet Printheads".

* cited by examiner

*Primary Examiner*—N. Le
*Assistant Examiner*—Shih-wen Hsieh
(74) *Attorney, Agent, or Firm*—Flory L. Martin

(57) ABSTRACT

A multi-tiered, multi-faceted, anti-flicking wiper scraper system cleans an inkjet printhead wiper without flicking or splattering ink residue onto other components in an inkjet printing mechanism. This system includes a scraper apparatus supported by a service station frame to contact the wiper through relative motion of the wiper and scraper apparatus. The scraper apparatus may take the form of two scraper bars which extend into the path of the wiper, with the first scraper bar being shorter than the second scraper bar, and with the first scraper bar being rigidly or pivotally supported by the frame. The scraper apparatus may be a unitary body defining two ramped wiping surfaces joined at an apex portion of the body, or a body having a scraping surface covered with a series of ridges. A method is also provided to clean ink residue from an inkjet printhead.

38 Claims, 3 Drawing Sheets

FIG. 4
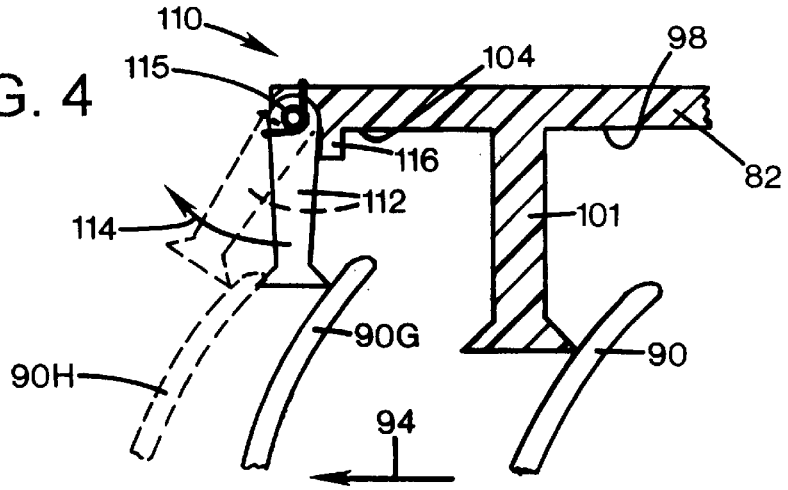
FIG. 5
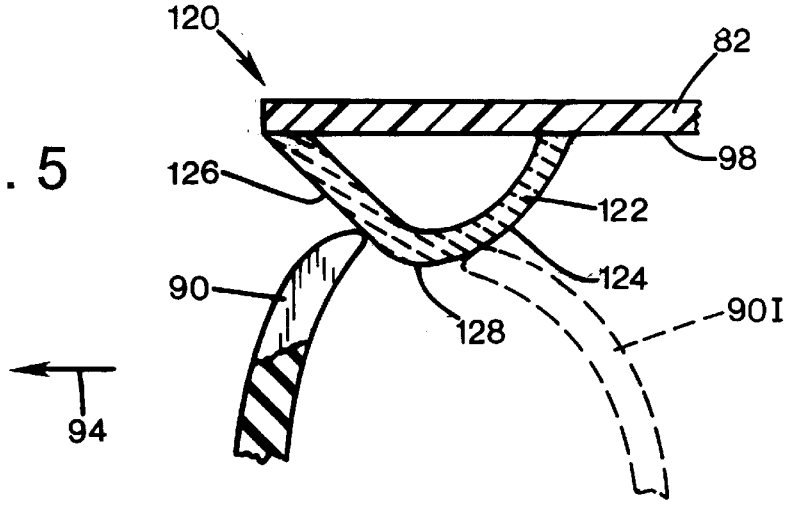
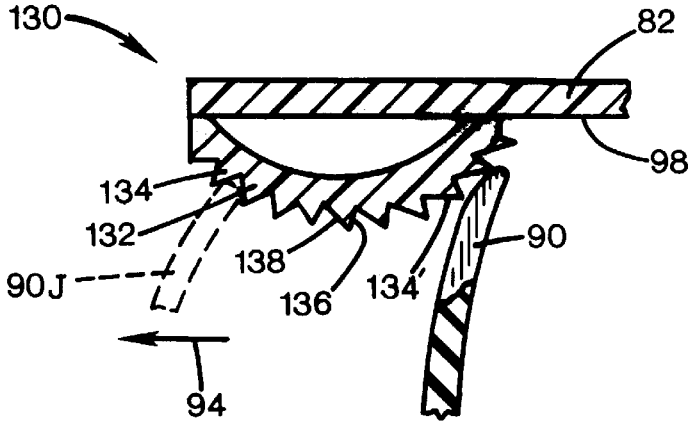
FIG. 6

MULTI-FACETED WIPER SCRAPER SYSTEM FOR INKJET PRINTHEADS

FIELD OF THE INVENTION

The present invention relates generally to inkjet printing mechanisms, more particularly to a wiper scraper system that removes ink residue from a flexible wiper after cleaing an inkjet printhead, and even more particularly to a multi-tiered, multi-faceted, anti-flicking wiper scraper system that cleans the wiper without flicking or splattering the ink residue onto other components in the printing mechanism.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media. Unfortunately, the combination of small nozzles and quick drying ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality. Thus, keeping the nozzle face plate clean becomes even more important when using pigment based inks, because they tend to accumulate more debris than the earlier dye based inks.

Indeed, keeping the nozzle face plate clean for cartridges using pigment based inks has proven quite challenging. With the earlier dye-based inks, wiping the printhead with an elastomeric wiper was sufficient. However, with the advent of the pigment-based inks, a secondary operation of cleaning the wiper has become necessary to remove sticky pigment ink residue from the wiper. In the early printers using these pigment based inks, this secondary wiper cleaning operation was accomplished using a rigid plastic scraper. Through relative motion of either the scraper, the wiper blade, or both, the wiper was scraped across the plastic cleaner to remove ink from the surfaces of the wiper blade. Unfortunately, the pigment-based ink residue would accumulate on the wiper surface in the form of a paste, which the earlier plastic scraper was not totally effective in removing. Instead, when encountering this paste-like consistency of ink residue, the plastic scraper tended to smear the ink on the surface of the wiper, rather than removing it. Another drawback of the plastic scraper is the tendency of the wiper blade when moving past the scraper to flick ink off of the cleaning surface.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote stationary location within the printer. There are a variety of advantages associated with these off-axis printing systems, but the permanent or semi-permanent nature of the printheads requires special considerations for servicing, particularly when wiping ink residue from the printheads, which must be done without any appreciable wear that could decrease printhead life. To accomplish this objective, an ink solvent has been used in an off-axis printer, specifically the DeskJet 2000C color inkjet printer, sold by the present assignee Hewlett-Packard Company. In this ink solvent system, a polyethylene glycol ("PEG") compound is stored in a porous medium such as a plastic or foam block that is in intimate contact with a reservoir, with this porous block having an applicator portion exposed so the elastomeric wiper can contact the applicator. This elastomeric wiper moves across the applicator to collect PEG, which is then wiped across the printhead to dissolve accumulated ink residue and to deposit a non-stick coating of PEG on the printhead face to retard further collection of ink residue. The wiper then moves across a rigid plastic scraper to remove dissolved ink residue and dirtied PEG from the wiper before beginning the next wiping stroke. The PEG fluid also acts as a lubricant, so the rubbing action of the wiper does not unnecessarily wear the printhead.

Other wiper scraper systems without a solvent have also been sold by the Hewlett-Packard Company in the DeskJet 850C, 855C, 870C 890C and 895C models of color inkjet printers. These scraper systems used a rotary tumbler to scrape the each wiper across a single, associated, cammed scraper. Another wiper system is shown in U.S. Pat. No. 5,815,176. An additional solventless wiper scraper system has been sold by the present assignee, the Hewlett-Packard Company, in the DeskJet 720C and 722C models of inkjet printers, which used a translating pallet to move the wipers into contact with a single stationary scraper bar. Another system having fabric-lined or bristle-lined wiper scrapers has also been proposed. Unfortunately, both the scraper systems that use an ink solvent, and those that do not, tended to flick ink residue into undesirable locations, such as along the side of the printhead and along the interior walls of the service station. In some cases, the ink residue landed in the printhead caps for other colors, leading to cross contamination and mixed colors when printing, which is then manifested as poor print quality. In other instances, the residue was flicked onto the service station gear mechanism, where it fouled the gear operation, or onto a cartridge's electrical interconnect with the carriage where it often promoted shorts. Moreover, this flicking action, which occurs after scraping when the wiper snaps back to an upright position, also generates undesirable noise as the wipers snap off the scraper at high speeds and then vibrate to an eventual stop.

Thus, a need exists for an inkjet printhead cleaning system which scrapes ink residue and ink solvent from the wiper while minimizing ink flicking from the wiper blade, and which is quieter than the earlier wiper scraper designs.

SUMMARY OF THE INVENTION

According to several aspects of the present invention, a multi-faceted wiper scraper system is provided for cleaning a wiper that has been used to wipe an inkjet printhead in an inkjet printing mechanism without flicking or splattering ink residue onto other components in the printing mechanism. As used herein, the term "facet" is not limited to planar geometric shapes, as in the "facets of a diamond," but instead this term should be thought of as referring to the many aspects or views that may be considered on a particular topic, or in this case, as the many different approaches used to solve the ink flicking problems experienced in the past, with these approaches having varying geometries and steps.

According to one aspect of the present invention, a multi-faceted scraper system is provided for cleaning ink residue from a wiper that has wiped the ink residue from an inkjet printhead in an inkjet printing mechanism. The scraper system includes a frame and a scraper apparatus. The scraper apparatus is supported by the frame to contact and scrape ink residue from the wiper through relative motion of the wiper and the scraper apparatus in a first stroke and in a second stroke. The scraper apparatus is configured to promote vibration of the wiper after contacting the scraper apparatus during the first stroke and to dampen vibration of the wiper after contacting the scraper apparatus during the second stroke.

According to yet another aspect of the present invention, a method is provided for cleaning ink residue from an inkjet printhead in an inkjet printing mechanism, including the step of wiping ink residue from the printhead and collecting the ink residue on a wiper. In a first scraping stroke, the ink residue is scraped from a first surface of the wiper. In a vibrating step, the wiper is vibrated after the first scraping stroke. In a shaking step, ink residue is shaken from the wiper during the vibrating step. In a second scraping stroke, the ink residue is scraped from a second surface of the wiper. Finally, in a dampening step, vibration of the wiper is dampened following the second scraping stroke.

According to another aspect of the present invention, an inkjet printing mechanism is provided as including an inkjet printhead and a carriage that reciprocates the printhead through a printzone for printing and to a servicing region for printhead servicing. The printing mechanism also has a service station frame located in the servicing region, a wiper and a platform. The platform supports the wiper for movement through a wiping stroke for cleaning ink residue from the printhead when in the servicing region, through a first scraping stroke, and through a second scraping stroke. The printing mechanism also has a multi-faceted scraper system for cleaning ink residue from the wiper following the wiping stroke. The multi-faceted scraper system includes a scraper apparatus supported by the service station frame to contact and scrape ink residue from the wiper through relative motion of the wiper and the scraper apparatus during the first scraping stroke and during the second scraping stroke. The scraper apparatus is configured to promote vibration of the wiper after contacting the scraper apparatus during the first scraping stroke and to dampen vibration of the wiper after contacting the scraper apparatus during the second scraping stroke.

An overall goal of the present invention is to provide an inkjet printing mechanism which prints sharp vivid images over the life of the printhead and the printing mechanism, particularly when using fast drying pigment or dye-based inks, whether dispensed from an off-axis system or from a replaceable ink cartridge system.

Another goal of the present invention is to provide a multi-faceted wiper scraper system and method for cleaning printhead wipers in an inkjet printing mechanism.

Still another goal of the present invention is to provide a multi-faceted wiper scraper system for cleaning printhead wipers in an inkjet printing mechanism, with the system being cleaner and quieter than earlier systems, and which thus provides consumers with a reliable, quiet inkjet printing unit.

BRIEF DESCRIPTION OF THE DRAWINGS

FIG. 4 is an enlarged sectional view of a first alternate embodiment for the multi-faceted wiper scraper system of FIG. 1.

FIG. 5 is an enlarged sectional view of a second alternate embodiment for the multi-faceted wiper scraper system of FIG. 1.

FIG. 6 is an enlarged sectional view of a third alternate embodiment for the multi-faceted wiper scraper system of FIG. 1.

DETAILED DESCRIPTION OF A PREFERRED EMBODIMENT

Figure 1:
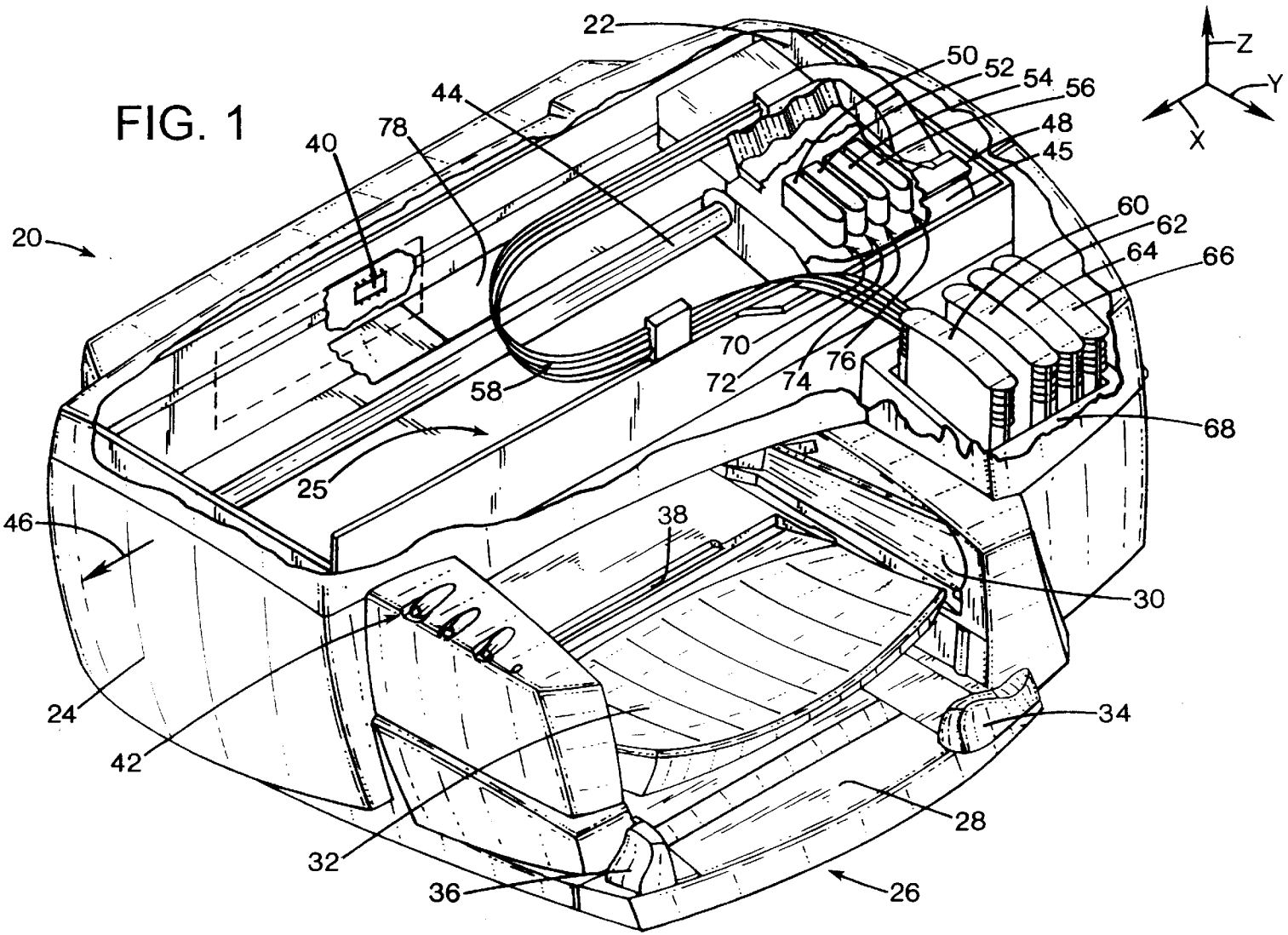
FIG. 1 is a perspective view of one form of an inkjet printing mechanism, here, an inkjet printer, including a printhead service station having one form of a multi-faceted, multi-tiered, anti-flicking wiper scraper system of the present invention for cleaning an inkjet printhead wiper.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a stepper motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slideably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

Figure 2:
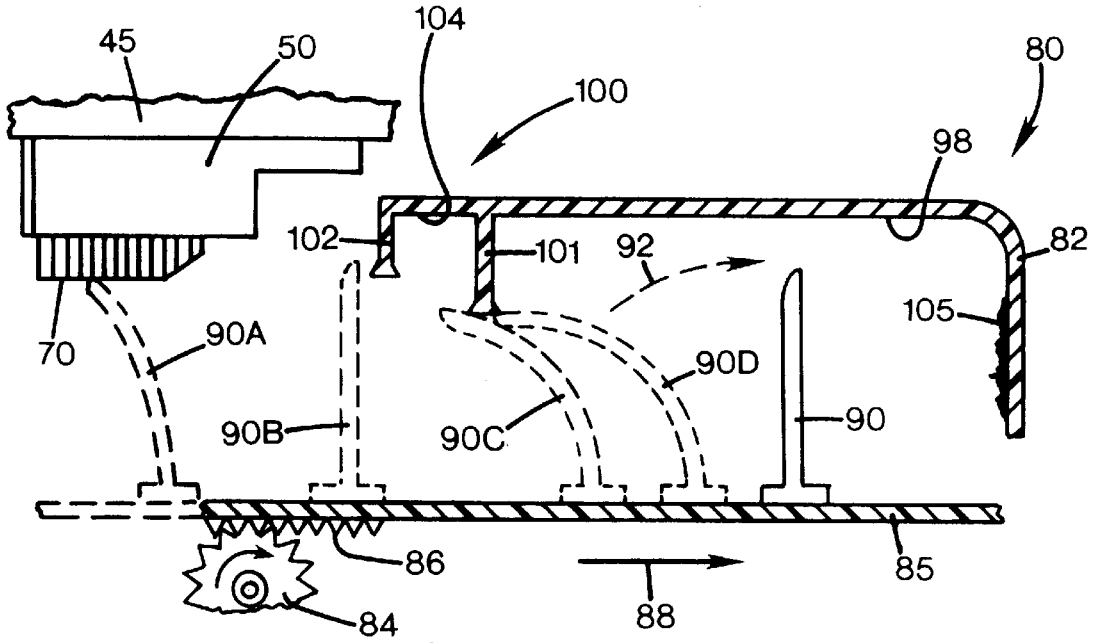
FIG. 2 is a side elevational view of the multi-faceted wiper scraper system of FIG. 1, shown cleaning a printhead and a wiper in a forward direction of movement.

In the printzone 25, a sheet of print media receives ink from an inkjet cartridge, such as a black ink cartridge 50 and three monochrome color ink cartridges 52, 54 and 56, shown schematically in FIG. 2. The cartridges 50–56 are also often called "pens" by those in the art. The black ink pen 50 is illustrated herein as containing a pigment-based ink. While the illustrated color pens 52–56 may contain pigment-based inks, for the purposes of illustration, color pens 52–56 are described as each containing a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system, whereas systems which store the main ink supply at a stationary location remote from the printzone scanning axis are called "off-axis" systems. Other hybrid systems known as "snapper systems" have replaceable ink reservoirs which snap onto permanent or semi-permanent printheads. All of these different types of printhead systems may be cleaned using the servicing system described below.

In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to from an image on a sheet of media in the printzone 25. The concepts disclosed herein for cleaning the printheads 70–76 apply equally to the totally replaceable inkjet cartridges and snapper systems, as well as to the illustrated off-axis semi-permanent or permanent printheads, although the greatest benefits of the illustrated system may be realized in snapper and off-axis systems where extended printhead life is particularly desirable.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

Multi-Faceted, Anti-Flicking

Wiper Scraper Service Station System

Figure 3:
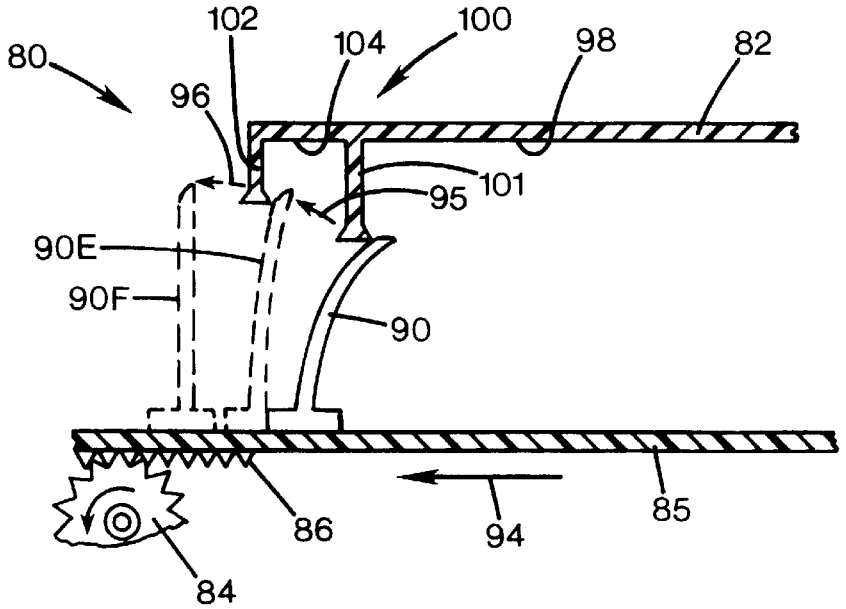
FIG. 3 is a side elevational view of the multi-faceted wiper scraper system of FIGS. 1 and 2, shown cleaning the wiper in a reward direction of movement.

FIGS. 2 and 3 illustrate one form of a multi-faceted, anti-flicking wiper scraper service station system 80 constructed in accordance with the present invention. The service station 80 includes a stationary frame 82 which is supported by the printer chassis 22 in the servicing region 48 within the printer casing 24. To service printheads 70–76 of the pens 50–56, the service station 80 includes a stepper motor and pinion gear assembly 84 coupled to drive a moveable platform or pallet member 85 through engagement with a rack gear 86 located along the underside of the pallet 85. Here, the servicing platform 85 is shown as a translationally moving member, moving in a forward direction as indicated by arrow 88 in FIG. 2, although a rotary platform, or a combination platform having both rotary and translational motion, may also be used.

Several wiper blades, such as wiper blade 90, may be supported along the upper surface of the pallet 85. Indeed, the platform 85 may support one, two or more wiper blades (not shown) per printhead 70–76, but for the purposes of operational illustration, only a single black wiper blade 90 is shown for cleaning the black printhead 70. The wiper blades may be of a resilient, non-abrasive, elastomeric material, such as nitrile rubber, ethylene polypropylene diene monomer (EPDM), or other comparable materials known in the art. For the wiper 90, a suitable durometer, that is, the relative hardness of the elastomer, may be selected from the range of 35–80 on the Shore A scale, or more preferably within the range of 60–80, or even more preferably at a durometer of 70±/−5, which is a standard manufacturing tolerance.

In FIG. 2, the final resting position of the wiper 90 is shown in solid lines, with several earlier positions 90A, 90B, 90C and 90D being shown in dashed lines. The flexing travel of the wiper 90 between positions 90C, 90D and the solid line position is shown by dashed arrow 92 as pallet 85 has moved in the forward direction 88. FIG. 3 shows wiper 90 in solid lines at a beginning to clean position after the platform 85 has begun to travel rearwardly, as indicated by arrow 94. Several later positions of wiper 90 are shown in dashed lines in FIG. 3, labeled as 90E and 90F, with the flexing travel of the wiper being shown by arrows 95 and 96. In the at rest position of the wiper 90, shown in solid lines in FIG. 2, we see the wiper stored inside a wiper chamber 98, which is defined by the service station frame 82.

The anti-flicking, multi-faceted wiper scraper service station system 80 includes a multi-faceted, dual-tiered wiper scraper system 100, constructed in accordance with the present invention, which includes a primary, inboard or internal scraper 101 and a secondary, outboard or external scraper 102. The terms "inboard" and "outboard," as well as "internal" and "external" for the scrapers 101 and 102 are used with respect to the wiper chamber 98, although is apparent that in some implementations of the multi-faceted scraper systems illustrated herein may eliminate the wiper storage chamber 98 if desired. Both scrapers 101 and 102 extend downwardly from the service station frame 82 into the path of the wiper blade 90 when moved into and out of the storage chamber 98. The illustrated scrapers 101 and 102 each terminate in a scraping head which has an inverted T-shape, although it is apparent that other shapes may be used for the scraper heads, such as an inverted Y-shape for instance. Preferably, the primary scraper 101 is longer than the secondary scraper 102. In FIG. 2, the incoming wiper at the position 90B first contacts the shorter scraper 102, then the wiper hits the longer primary scraper 101, as shown in wiper positions 90C and 90D, respectively. The primary scraper 1O1 and secondary scraper 102 are separated by an inter-scraper span of the service station frame 82, which together with scrapers 101 and 102 defines a scraper chamber or cavity 104 along the interior of the service station frame 82. In the illustrated embodiment, the center-line-to-center-line distance between the primary and secondary scrapers 101 and 102 is preferably about 7 mm.

The printhead wiping operation is shown in FIG. 2 at wiper position 90A, where we see the wiper blade 90 wiping across the orifice plate of the black printhead 70 to remove any ink residue and/or ink solvent from the printhead. In the illustrated embodiment, the printhead is held stationary by the carriage 45 during this wiping step, although in some implementations it may be desirable to hold the wiper stationary while moving the printhead to accomplish this wiping step. Continued forward motion of the pallet 85, as indicated by arrow 88, carries the wiper through an entry scraping stroke where the wiper 90 moves first into contact with the outboard scraper 102 just past position 90B. The wiper 90 easily passes this secondary scraper 102 due to a selected small interference fit between the wiper tip and the distal lower end of the scraper 102, with this interference fit being on the order of 0.5–0.75 mm (millimeters) in the illustrated embodiment. Indeed, during the entry stroke, the outboard scraper 102 serves a pre-cleaning function by removing a majority of ink residue from the peak or tip of the wiper blade 90, followed by the inboard primary scraper 101 providing a more complete cleaning of the front surface of wiper blade 90, as shown at positions in 90C and 90D. Preferably, the interference fit between the tip of wiper 90 and the distal lower end of the primary scraper 1O1 is on the order of 2.5 millimeters, as a nominal value.

Upon leaving contact with the primary scraper 101, in the transition from position 90D to the solid line position in FIG. 2, the wiper 90 vibrates forward and backward, flicking off most of the remaining fluid onto the dead-end interior walls of the service station chamber 98, as illustrated by ink residue 105. Recall that if the wiping system uses an ink solvent in a particular implementation, then this "ink residue" discussed herein may also contain liquid and solid constituents of the solvent composition, as well as dissolved ink components. The accumulation of this ink residue 105 within chamber 98 is harmless because there are no other printhead servicing components located in this region. Sound generated by this free vibration of the wiper blade 90 is muffled somewhat by the chamber 98. This free flicking motion is preferred inside chamber 98 over a dampened motion because a free flicking motion mechanically throws as much fluid residue as possible into the chamber 98, resulting in less fluid remaining on blade 90 to be flicked off upon exiting from the chamber 98, as shown in FIG. 3.

FIG. 3 shows the rearward exit of the wiper from the storage chamber 98, as the platform 85 moves in the direction of arrow 94. During this backward motion toward the pens 50–56, the wiper blade 90 is scraped by the inboard scraper 101 first. Most of the fluid remaining on the rearward surface of the wiper 90, which had not been removed during the forward scraping stroke or during the free vibration of the wiper inside chamber 98, is then trapped and accumulated at scraper 101. After passing the inboard scraper 101, the wiper 90 moves into position 90E, where its rearward flicking momentum is stopped by contact with the outboard scraper 102. After passing the inboard scraper 101, any fluid remaining on the wiper blade 90 is flicked into the inter-scraper region 104, and along the interior upper surface of the outboard scraper 102, which acts as a shield trap this ink residue. Thus, the shorter scraper 102 not only stops the momentum of the wiper blade 90 in bouncing back to its natural upright shape, but scraper 102 also serves to prevent fluid from being flicked onto the pens or other service station components, such as caps, primers and the like. The relatively low interference fit between wiper blade 90 and the outboard scraper 102 allows the blade 90 to easily pass under scraper 102, which imparts less potential energy to the blade 90, resulting in minimal blade vibration and very little ink flicking as the blade passes from position 90E to 90F. This minimal ink flicking upon exiting the scraper region 100 drastically improves the acoustics of the service station 80, resulting in a quieter overall operation of printer 20.

FIG. 4 illustrates an alternate embodiment of an active anti-flicking wiper scraper system 110, constructed in accordance with the present invention. Here, we see the outboard or primary scraper 101 constructed as described above, but a new secondary scraper 112 is shown pivoted to the scraper frame 82 for motion in the direction of curved arrow 114 as the wiper 90 progresses from position 90G to 98H. A biasing element, such as a coil spring 115, may be used to return the secondary scraper 112 from the active dashed line position in FIG. 4 to the solid line at-rest position. The service station frame 82 may include a stop 116 to locate the active scraper 112 in a fixed position for scraping during a forward scraping stroke, which may be accomplished as described above with respect to FIG. 2.

The spring loaded scraper 112 yields when contacted by the wiper blade 90, as can be seen by comparing the solid line and dashed line positions in FIG. 4. The spring loaded nature of scraper 112 acts to prevent flicking of the ink residue. Before release of the wiper blade from position 90H, the rearward pivoting motion of scraper 112 has decreased the amount of vertical interference between the blade and the scraper, from that shown in wiper position 90G, which would be the case if the secondary scraper was fixed, as shown for scraper 102 in FIGS. 2 and 3. Upon leaving contact with scraper 112, this lower interference fit between the blade and the scraper at position 90H imparts a lower potential energy to the wiper blade 90 because the blade has returned to a position which is closer to upright before leaving the scraper. This lower exiting potential energy decreases the residual vibration of the wiper 90 in returning to the upright relaxed position, resulting in a minimal amount of ink flicking. In other words, by slowing the return of the blade 90 to an upright position, the spring loaded scraper 112 minimizes ink flicking toward the pens and other service station components.

One of the main advantages of the active scraper system 110 is that the spring loaded outboard scraper 112 may be used with a greater range of tolerance variations, that is, with wipers having a larger range of interference fit values with the scraper 112 than described above for multi-tiered passive scraper system 100. The spring loaded nature of scraper 112 allows it to yield under the greater contact pressure of a larger interference fit with the wiper blade 90 without increasing the ink flicking. That is, a taller than nominal wiper blade swings the scraper 112 further upon exiting the wiper chamber 98, allowing the scraper to slow the vibration of the blade in returning to a relaxed upright position, resulting in far less ink flicking than would be experienced with such a tall blade in the passive system 100. With the active scraper system 110, this insensitivity to manufacturing tolerance stacks is particularly advantageous because it allows the service station 80 to be assembled with parts having wider tolerance variations, which are inherently more economical to produce, resulting in a more economical printer 20 for consumers.

FIG. 5 shows a second alternate embodiment of an anti-flicking wiper scraper system 120, constructed in accordance with the present invention. The multi-faceted scraper system 120 has a scraper body 122 supported by the service station frame 82. The illustrated scraper body 122 has a pair of ramped surfaces including an interior or inboard surface 124, and an exterior or outboard surface 126, which together act as a pair of scraper members. While the scraper body 122 may be symmetrical, in the preferred embodiment, the outboard surface 126 is a relatively straight ramp, while the interior ramp 124 has an arcuate cross sectional shape. In some implementations the arcuate ramp 124 may have a cross section which is circular, parabolic, hyperbolic, or other curved shapes or combinations thereof, including combinations of curved and straight ramped portions. Indeed, the outboard ramp 126 in some implementations may also be a curved ramp or a combination of curved and straight ramped portions. The illustrated straight ramped surface 126 dampens wiper vibration upon leaving the wiper chamber 98, as shown in the solid line position in FIG. 5. The arcuate interior ramp promotes vibration of the wiper blade 90 upon entry into the chamber 98 as the blade snaps off the ramp, as shown in the dashed line position 901. The straight ramped surface 126 gradually releases the potential energy stored in the blade in small increments as the blade returns to an upright orientation ready for another wiping stroke.

Preferably, the body 102 is constructed of a porous material to wick away liquid ink residue through capillary action and then store this liquid in a storage reservoir or other remote convenient location. This porous material for body 122 may be of a variety of different materials, for instance, an open-cell thermoset plastic such as a polyurethane foam, a sintered polyethylene, or other functionally similar materials known to those skilled in the art. Such a sintered polyethylene material has proved useful in storing and supplying an ink solvent for application to the wipers, such as employed in the Hewlett-Packard Company's model 2000C color inkjet printer, as well as for absorbing liquid ink residue in the Hewlett-Packard Company's 800 series color inkjet printers. Thus, the material of body 122 may also serve to absorb some of the liquid components of ink residue and any ink solvent which may be used by the service station 80.

It is apparent that during a forward wiping stroke, upon entry of the wiper blade 90 into chamber 98, the outboard surface 126 first removes a majority of ink residue from the forward facing surface of blade 90, with additional fluid residue being flicked onto the interior walls of chamber 98 as the blade 90 is quickly released from the arcuate ramped surface 124, as shown for the blade in position 90I. Upon exiting chamber 98, as shown in FIG. 5, during the rearward scraping stroke, the body interior surface 124 removes ink residue from the rearward facing surface of blade 90. As the wiper blade 90 moves rearwardly (arrow 94) and passes an apex portion 128 of body 122, the tip of the wiper blade 90 then traverses upwardly along the exterior surface 126, as shown in FIG. 5. This continued contact of the wiper blade 90 with the body exterior surface 126 slows the return of the blade 90 to an upright position, minimizing ink flicking toward the pens and other servicing components. By stopping the violent snap of the wiper blade 90 back to an upright position, the V-shaped body 122 also minimizes the acoustic impact of wiper scraping, resulting in a quieter operating printer 20.

FIG. 6 illustrates a fourth embodiment of an anti-flicking, multi-faceted wiper scraper system 130, constructed in accordance with the present invention. Here, the wiper scraper system 130 includes a gear-like body 132, which has a series of ridges or elongate tooth-like scraper members 134, with each ridge having an interior or inboard surface 136 and an exterior or outboard surface 138. While the body 132 is illustrated as being basically cylindrical and covered with ridges, it is apparent that the body 132 may have an unsymmetrical shape, as illustrated above for body 122, then covered with ridges. Preferably, the gear scraper body 132 may be constructed of a hard plastic, or of a soft rubber or other elastomer, such as of the same type of elastomer used for the wipers, as described above. If constructed of a rubber or other elastomeric material, the scraper members 134 may advantageously be compressed together during the scraping strokes to squeeze out ink residue therebetween. In the illustrated embodiment, the ridged scraper members 134 each have a length which runs in a direction substantially perpendicular to the direction (arrow 94) of the scraping strokes. It is apparent that other arrangements of the ridges may also be used, such as a helical arrangement like a helical gear, or an arrangement of segmented ridges or other patterns, rather than the illustrated unitary ridges 134 which run the entire width of the scraper body 132.

Upon entry of the wiper blade 90 into the wiper chamber 98, the outboard surfaces 138 of the ridges remove ink residue from forward facing surface of wiper blade 90, with the blade flicking any additional liquid residue into the interior of chamber 98, as described above with respect to FIG. 2. Indeed, to aid this flicking, the ridges 134 may be non-symmetrically constructed, such as shown for ridge 134' which has a lower surface that is substantially horizontal, allowing the blade 90 to enter smoothly into a flicking stroke within the interior of the chamber 98.

During a rearward exiting stroke (arrow 94 in FIG. 6), the ridge inboard surfaces 136 serve to dampen the flicking action and vibration of the wiper blade 90, as shown in dashed lines in position 90J, allowing the wiper blade 90 to return closer to a more upright position before exiting the wiper scraper 130. Thus, the interior surfaces 136 of the ridges 134 not only serve to remove ink residue from the rearward facing surface of the blade 90, but surfaces 136 also serve to dampen the return of blade 90 to the upright position. This dampening action of ridges 134 minimizes ink flicking onto the pens and other service station components. Moreover, the dampening action of the ridges 134 also dampens the acoustical impact of the blade 90 returning to an upright position, resulting in a quieter printer 20.

Thus, a new method of removing ink residue from a wiper blade which has just cleaned an inkjet printhead may be described with respect to the scraper systems 100, 110, 120 and 130 of FIGS. 2–6. In this method, ink is removed from a first surface of each wiper blade during an entry scraping stroke, followed by an exiting scraping stroke to remove ink residue from an opposing second surface of each blade. During the entry stroke, an outboard scraper member first removes ink residue from the first surface of the blade, followed by an inboard scraper member removing additional residue from the blade first surface. The entry stroke ends by allowing ink residue to be flicked from the wiper within the interior of the wiper chamber 98. During the exiting scraping stroke, ink residue is removed from the second surface of the wiper blade by the inboard scraper, followed by a damping of the return of the wiper blade to upright position through contact with the outboard scraper.

In the embodiment of scraper system 100 (FIGS. 2–3), both the inboard scraper 101 and the outboard scraper 102 are stationary. In the embodiment of active scraper system 110 (FIG. 4), the outboard scraper 112 is spring loaded with respect to the service station frame 82, allowing the scraper 112 to swing outwardly as the blade 90 passes underneath this scraper to exit the scraper system 120. In the embodiment of system 120 (FIG. 5), the outboard scraper and inboard scraper members form two opposing ramps, joining in an apex portion under which the wiper blade 90 passes during the scraping strokes. During the exiting stroke, wiper damping is accomplished by allowing the wiper blade to travel upwardly along the outboard ramp surface 126, while ink flicking is promoted when the wiper quickly leaves the arcuate ramp 124. In the embodiment of system 130 (FIG. 6), the wiper scraper comprises a series of gear-like teeth 134, with each gear tooth having an outboard surface 138 and an inboard surface 136. Ink flicking is minimized to during the exiting stroke by the progression of the wiper blade upwardly along the gear teeth from one succeeding gear to the next higher elevation gear tooth, thereby damping the return of the blade to an upright position.

Conclusion

A variety of advantages may be realized using the multi-faceted scraper systems 100, 110, 120 and 130. One of the main advantages of the illustrated scraper systems is the resulting quieter printer operation from dampening the return of the wiper to an upright position upon exiting the wiper chamber 98. Another significant advantage of this dampening action is the minimization of the occurrences ink being flicked onto the pens and other service station components. Furthermore, use of the active scraper system 110 enhances the ability of the system to accommodate a wider range of component tolerance stacks, allowing for more economical components to be used to assemble printer 20.

It is apparent that the concepts illustrated by the scraper systems 100, 110, 120 and 130 may be implemented in a variety of different ways. For instance, while the motion of the service station platform 85 has been illustrated as being in forward and rearward directions 88 and 94, it is apparent that some implementations may use lateral motion, such as parallel to the printhead scanning axis 46. Moreover, while the wiper is illustrated as passing "under" the scrapers, in some implementations the wipers may pass over the scrapers. One important concept here is the relative motion of the wipers with respect to the scraper members. For instance, the platform 85 may be constructed to rotate to move the wipers past the scrapers, the scrapers may be moveably mounted to the service station frame 82 to move into contact with the wipers, or scraping may be accomplished through motion of both the wipers and scrapers. Indeed, the wiper chamber 98 may be eliminated if the flicked ink residue 105 lands in a non-critical location within the printer casing 24.

Other modifications may be made, such as by making scraper bodies 122 and 132 of a solid construction rather than the illustrated hollow construction, or by making the scraper bodies of a composite material construction, with some portions having absorbent properties and other portions having elastomeric properties. While the ramps 124 and 126 of scraper body 122 are shown as being joined at the apex 128, it is apparent that the ramps 124, 126 may be joined by a flat section, or they may be totally separated from each other. Indeed, the concepts illustrated by the scraper systems 100, 110, 120 and 130 may be combined, for example, by forming scraper teeth similar to teeth 134 along one or both of the ramped surfaces 124 and 126 of scraper body 122.

We claim:

1. A multi-faceted scraper system for cleaning ink residue from a wiper after wiping an inkjet printhead in a printing mechanism, comprising:

a frame; and first and second scraper members each supported by the frame to contact the wiper during opposing first and second strokes to scrape ink residue therefrom through relative motion of the wiper and scraper members, with the first scraper member contacting the wiper first during the first stroke and last during the second stroke, with the second scraper member configured to promote vibration of the wiper after the first stroke, and the first scraper member configured to dampen vibration of the wiper after the second stroke.

2. A multi-faceted scraper system according to claim 1 wherein:

the first scraper member comprises a first scraper bar having a first extent of interference contact with the wiper during the first and second strokes; and the second scraper member comprises a second scraper bar having a second extent of interference contact with the wiper during the first and second strokes, with the second extent of interference contact being greater than the first extent of interference contact.

3. A multi-faceted scraper system according to claim 2 wherein the first scraper bar and the second scraper member in cross section each have a proximate end supported by the frame and a distal end having an inverted T-shape.

4. A multi-faceted scraper system according to claim 1 wherein the first scraper member is pivotally attached to the frame for pivotal motion between a rest position and an active position when contacted by the wiper during the second stroke.

5. A multi-faceted scraper system according to claim 4 further including a stop member against which the first scraper member rests when in the rest position and during the first stroke.

6. A multi-faceted scraper system according to claim 4 further including a biasing member which biases the first scraper member toward the rest position following the second stroke.

7. A multi-faceted scraper system according to claim 1 wherein:

the first scraper member comprises a first ramp extending from the frame to terminate at a distal end so the wiper travels toward the distal end during the first stroke and away from said distal end during the second stroke; and the second scraper member comprises a second ramp extending from the frame to terminate at a distal end so the wiper travels away from the distal end during the first stroke and toward said distal end during the second stroke.

8. A multi-faceted scraper system according to claim 7 wherein the first ramp has a substantially straight cross section, and the second ramp has an arcuate cross section.

9. A multi-faceted scraper system according to claim 1 wherein the frame defines a wiper chamber having walls which collect ink residue propelled off of the wiper during wiper vibration following the first stroke.

10. A multi-faceted scraper system according to claim 1 wherein, while scraper apparatus is held stationary, the first and second strokes are accomplished by moving the wiper.

11. A multi-faceted scraper system according to claim 10 wherein the frame defines a wiper chamber within which the scraper apparatus is located, with the wiper transitioning from the first stroke to the second stroke inside the wiper chamber.

12. A multi-faceted scraper system for cleaning ink residue from a wiper after wiping an inkjet printhead in a printing mechanism, comprising:

a frame; and a scraper apparatus comprising a unitary body staionarily supported by the frame, with the body defining first and second ramps joining at an apex portion of the body, with the first and second ramps each contacting the wiper during opposing first and second strokes to scrape ink residue therefrom through relative motion of the wiper and scraper members, with the first ramp contacting the wiper first during the first stroke and last during the second stroke, with the second ramp configured to promote vibration of the wiper after the first stroke, and the first ramp configured to dampen vibration of the wiper after the second stroke.

13. A multi-faceted scraper system according to claim 12 wherein the first and second ramps and the apex portion of the body together define a cleaning surface comprising a plurality of ridges.

14. A multi-faceted scraper system according to claim 13 wherein the ridges are linear and substantially mutually parallel.

15. A multi-faceted scraper system according to claim 14 wherein:

the first stroke is in a first direction; and each ridge has a length running in a direction substantially perpendicular to the first direction.

16. A multi-faceted scraper system according to claim 13 wherein each ridge has a first surface and a second surface, with the wiper contacting the first surface of at least one of the ridges during the first stroke, and with the wiper contacting the second surface of at least one of the ridges during the second stroke.

17. A multi-faceted scraper system according to claim 16 wherein at least one of the ridges has a cross sectional shape which is different from a cross sectional shape of another one of the ridges.

18. A multi-faceted scraper system according to claim 12 wherein the body is of a porous material which wicks liquid ink residue through capillary action.

19. An multi-faceted scraper system according to claim 12 wherein the frame defines a wiper chamber having walls which collect ink residue propelled off of the wiper during wiper vibration following the first stroke.

20. A multi-faceted scraper system according to claim 12 wherein, while scraper apparatus is held stationary, the first and second strokes are accomplished by moving the wiper.

21. A multi-faceted scraper system according to claim 20 wherein the frame defines a wiper chamber within which the scraper apparatus is located, with the wiper transitioning from the first stroke to the second stroke inside the wiper chamber.

22. A multi-faceted scraper system according to claim 10 wherein the first ramp has a linear cross sectional shape, and the second ramp has a curved cross sectional shape.

23. A multi-faceted scraper system according to claim 10 wherein the first ramp has a planar contour, and the second ramp has a convexly curved contour.

24. A multi-faceted scraper system according to claim 23 wherein the body is of a porous material which wicks liquid ink residue through capillary action.

25. A method of cleaning ink residue from an inkjet printhead in an inkjet printing mechanism, comprising the steps of:

wiping ink residue from the printhead and collecting the ink residue on a wiper;

in a first scraping stroke, scraping the ink residue from a first surface of the wiper;

vibrating the wiper after the first scraping stroke;

shaking ink residue from the wiper during the vibrating step;

in a second scraping stroke, scraping the ink residue from a second surface of the wiper; and dampening vibration of the wiper following the second scraping stroke wherein the first scraping stroke comprises contacting the wiper with a first scraper bar having a first extent of interference contact with the wiper, and then contacting the wiper with a second scraper bar having a second extent of interference contact with the wiper, with the second extent of interference contact being greater than the first extent of interference contact; and wherein the second scraping stroke comprises contacting the wiper with the second scraper bar, and then contacting the wiper with the first scraper bar.

26. A method according to claim 25 wherein the first scraping stroke comprises moving the wiper in a first direction, and the second scraping stroke comprises moving the wiper in a second direction opposite the first direction.

27. A method according to claim 25 further including the steps of:

during the second scraping stroke, moving the first scraper bar from a rest position to an active position whereat the dampening step occurs; and thereafter, returning the first scraper bar from the active position to the rest position.

28. A method according to claim 25 further including the steps of:

housing the wiper in a wiper chamber having walls during the vibrating step; and following the shaking step, collecting the ink residue on the chamber walls.

29. A method according to claim 28 further including the step of transitioning from the first scraping stroke to the second scraping stroke in the wiper chamber.

30. An inkjet printing mechanism, comprising:

an inkjet printhead;

a carriage that reciprocates the printhead through a printzone for printing and to a servicing region for printhead servicing;

a service station frame located in the servicing region;

a wiper;

a platform that supports the wiper for movement through a wiping stroke for cleaning ink residue from the printhead when in the servicing region, and through opposing first and second scraping strokes; and a multi-faceted scraper system for cleaning ink residue from the wiper following the wiping stroke, with the multi-faceted scraper system including first and second scraper members each supported by the service station frame to contact the wiper during both the first and second scraping strokes to scrape ink residue therefrom, with the first scraper member contacting the wiper first during the first stroke and last during the second stroke, with the second scraper member configured to promote vibration of the wiper after the first stroke, and the first scraper member configured to dampen vibration of the wiper after the second stroke.

31. An inkjet printing mechanism according to claim 30 wherein:

the first scraper member comprises a first scraper bar having a first extent of interference contact with the wiper during the first and second scraping strokes; and the second scraper member comprises a second scraper bar having a second extent of interference contact with the wiper during the first and second scraping strokes, with the second extent of interference contact being greater than the first extent of interference contact.

32. An inkjet printing mechanism according to claim 30 wherein the first scraper member is pivotally attached to the frame for pivotal motion between a rest position and an active position when contacted by the wiper during the second scraping stroke.

33. An inkjet printing mechanism according to claim 34 further including:

a stop member against which the first scraper member rests when in the rest position and during the first scraping stroke; and a biasing member which biases the first scraper member toward the rest position following the second scraping stroke.

34. An inkjet printing mechanism according to claim 30 wherein:

the frame defines a wiper chamber within which the scraper apparatus is located, with the wiper chamber having walls which collect ink residue propelled off of the wiper during wiper vibration following he first scraping stroke; and the wiper transitions from the first scraping stroke to the second scraping stroke inside the wiper chamber.

35. An inkjet printing mechanism, comprising:

an inkjet printhead;

a carriage that reciprocates the printhead through a printzone for printing and to a servicing region for printhead servicing;

a service station frame located in the servicing region;

a wiper:

a platform that supports the wiper for movement through a wiping stroke for cleaning ink residue from the printhead when in the servicing region, and through opposing first and second scraping strokes; and a scraper apparatus comprising a unitary body stationarily supported by the service station frame, with the body defining first and second ramps joining at an apex portion of the body, with the first and second ramps each contacting the wiper during both of the first and second scraping strokes to scrape ink residue therefrom, with the first ramp contacting the wiper first during the first stroke and last during the second stroke, with the second ramp configured to promote vibration of the wiper after the first stroke, and the first ramp configured to dampen vibration of the wiper after the second stroke.

36. An inkjet printing mechanism according to claim 35 wherein the unitary body of a porous material which wicks away liquid components of the ink residue from the wiper through capillary action.

37. An inkjet printing mechanism according to claim 35 wherein the first and second ramps and the apex portion of the body together define a cleaning surface comprising a plurality of ridges.

38. An inkjet printing mechanism according to claim 37 wherein each ridge has a first surface and a second surface, with the wiper contacting the first surface of at least one of the ridges during the first scraping stroke, and with the wiper contacting the second surface of at least one of the ridges during the second scraping stroke.

* * * * *

UNITED STATES PATENT AND TRADEMARK OFFICE

CERTIFICATE OF CORRECTION

PATENT NO. : 6,189,999 B1
DATED : February 20, 2001
INVENTOR(S) : Pham et al.

It is certified that error appears in the above-identified patent and that said Letters Patent is hereby corrected as shown below:

Column 16,
Line 11, delete “34” and insert therefor -- 32 --.
Line 24, delete “he” and insert therefor -- the --.

Signed and Sealed this

Twelfth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,189,999 B1
DATED : February 20, 2001
INVENTOR(S) : Pham et al.

It is certified that error appears in the above-identified patent and that said Letters Patent is hereby corrected as shown below:

Column 16,
Line 11, delete “34” and insert therefor -- 32 --.
Line 24, delete “he” and insert therefor -- the --.

Signed and Sealed this

Seventh Day of January, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,189,999 B1
DATED : February 20, 2001
INVENTOR(S) : Pham et al.

It is certified that error appears in the above-identified patent and that said Letters Patent is hereby corrected as shown below:

Column 14,
Lines 56 and 59, delete "10" and insert therefor -- 12 --.

Signed and Sealed this

Twelfth Day of April, 2005

JON W. DUDAS
*Director of the United States Patent and Trademark Office*